US006666951B1

(12) United States Patent
Kostiw

(10) Patent No.: US 6,666,951 B1
(45) Date of Patent: Dec. 23, 2003

(54) PROCESS FOR THE PRODUCTION OF ARTICLES FROM TREATED LIGNOCELLULOSIC PARTICLES AND A FORMALDEHYDE BASED RESIN BINDER

(76) Inventor: Darren J. Kostiw, 10619 - 109 Street, Westlock, Alberta (CA), T7P 1B8

( * ) Notice: Subject to any disclaimer, the term of this patent is extended or adjusted under 35 U.S.C. 154(b) by 0 days.

(21) Appl. No.: 09/807,289

(22) PCT Filed: Oct. 14, 1999

(86) PCT No.: PCT/CA99/00944

§ 371 (c)(1),
(2), (4) Date: Apr. 10, 2001

(87) PCT Pub. No.: WO00/23233

PCT Pub. Date: Apr. 27, 2000

(30) Foreign Application Priority Data

Oct. 16, 1998 (CA) ..... 2250645

(51) Int. Cl.[7] ..... B27N 1/00; B27N 1/02; D21H 17/54; D21H 17/57

(52) U.S. Cl. ..... 162/12; 156/62.4; 427/392; 428/355 AK; 428/524; 162/13; 162/24; 162/96; 162/97; 162/98; 162/99; 162/166; 162/218; 162/164.1

(58) Field of Search ..... 162/9, 13, 10, 162/11, 12, 76, 100, 164.1, 165, 96, 166, 218, 167, 97, 24, 25, 99, 20, 98; 156/62.2, 62.4; 428/524, 355 AK; 427/389.9, 392

(56) References Cited

U.S. PATENT DOCUMENTS

| | | | | |
|---|---|---|---|---|
| 3,919,017 A | | 11/1975 | Shoemaker et al. | |
| 3,930,110 A | | 12/1975 | Shoemaker et al. | |
| 4,320,208 A | | 3/1982 | Reischl et al. | |
| 4,478,738 A | | 10/1984 | Scholl et al. | |
| 4,608,407 A | | 8/1986 | Kerimis et al. | |
| 5,190,563 A | | 3/1993 | Herron et al. | |
| 5,385,754 A | | 1/1995 | Earl et al. | |
| 5,431,868 A | | 7/1995 | Hirano | |
| 5,520,777 A | | 5/1996 | Shisko | |
| 5,525,721 A | | 6/1996 | Ohshima et al. | |
| 5,529,663 A | | 6/1996 | Springer | |
| 5,582,682 A | * | 12/1996 | Ferretti | 162/100 |
| 5,608,051 A | | 3/1997 | Nelson et al. | |
| 5,750,201 A | | 5/1998 | Phanopoulos et al. | |
| 5,777,101 A | | 7/1998 | Nelson et al. | |
| 6,346,165 B1 | * | 2/2002 | Markessini et al. | 156/296 |

FOREIGN PATENT DOCUMENTS

| | | | |
|---|---|---|---|
| EP | 0 139 530 A | | 5/1985 |
| GB | 494 669 A | | 10/1938 |
| GB | 2 076 034 A | | 11/1981 |
| WO | 97/38833 | * | 10/1997 |
| WO | WO 98 37147 A | | 8/1998 |
| WO | WO 99 02318 A | | 1/1999 |

* cited by examiner

*Primary Examiner*—Steve Alvo
(74) *Attorney, Agent, or Firm*—Terrence N. Kuharchuk; Rodman & Rodman

(57) ABSTRACT

An improvement in the process for the production of articles from lignocellulosic material and a formaldehyde based resin binder comprising the step of treating the lignocellulosic material prior to combining it with the binder by exposing the lignocellulosic material to an acidic environment.

19 Claims, No Drawings

PROCESS FOR THE PRODUCTION OF ARTICLES FROM TREATED LIGNOCELLULOSIC PARTICLES AND A FORMALDEHYDE BASED RESIN BINDER

TECHNICAL FIELD

This invention relates to improvements to processes for the production of panels and other articles from lignocellulosic particles and binder.

BACKGROUND OF THE INVENTION

There are currently many different types of panels that are produced using wood as the raw material and bonded with one or more types of binders (i.e. glues). These panels include Oriented Strand Board ("OSB"), High Density Fibreboard ("HDF"), Medium Density Fibreboard ("MDF") and Particleboard ("PB"). The principle behind all of these products is to construct a mat using wood particles such as flakes or fibres and some type of glue and then to subject the mat to pressure and heat until the resin cures and the mat becomes a composite product.

The overwhelming majority of binders which are used in wood panel products are thermosetting formaldehyde based resins, which are selected primarily because of their low cost. Examples of such binders include urea formaldehyde resin ("UF"), melamine formaldehyde resin ("MF" or "MUF") and phenol formaldehyde resin ("PF"). Other binders which are sometimes used include isocyanate based glues such as methylene diphenyl isocyanate ("MDI") and its various polymeric forms. Although isocyanate based binders offer potentially a stronger bond between discrete wood particles, they are also very expensive relative to the formaldehyde based resins.

An emerging product is strawboard, which may be similar to OSB, HDF, MDF or PB but is constructed from straw particles instead of wood particles. Strawboard is potentially desirable from a resource conservation perspective because straws such as cereal straw are an annually renewable resource and are a by-product of agricultural operations, while wood supplies are diminishing as demand for wood products increases.

In the past, it has been found that isocyanate based binders such as MDI are preferred as the primary binder in the production of strawboard because strawboard produced with formaldehyde based resins such as UF tend to exhibit a significantly lower internal bond strength than those produced with MDI.

This lower internal bond strength has conventionally been attributed to a wax coating which covers straw particles and which has been believed to interfere with the adhesion between straw particles and relatively weak bonding agents such as UF. Unfortunately, the need to use expensive glues such as MDI in the production of strawboard has conventionally resulted in the strawboard product being costly to produce and thus of only marginal commercial value.

In addition to their expense, there are other problems associated with isocyanate based binders such as MDI. First, MDI is a very reactive substance and will bond with many material types including metals such as those typically used in press platens. This characteristic necessitates the use of release agents or some kind of physical barrier between the platens and the mat to be pressed, both of which result in added expense and potential production problems. Second, MDI vapour is hazardous to health and must therefore be managed accordingly. Third, MDI in its uncured state lacks "tack" or stickiness and thus does not impart any structural integrity to the mat before it is pressed. This characteristic means that the mat must be handled very carefully before pressing or it could fall apart. A fourth consideration is that laminate overlays do not bond to an MDI bonded surface as well as they do to a UF bonded surface.

There is therefore a need for a strawboard product which can be produced at least in part from glues other than isocyanate based binders.

SUMMARY OF THE INVENTION

The present invention is an improvement on a process for producing articles from lignocellulosic particles, wherein the process comprises the step of combining the lignocellulosic particles with a binder. In particular, the invention comprises the step of treating the particles of lignocellulosic material prior to combining them with the binder by exposing the lignocellulosic particles to an acidic environment.

Although the invention may be used effectively with any lignocellulosic particles including wood particles, the lignocellulosic particles are preferably comprised of straw particles of any type. More preferably the straw particles are selected from the group of plants consisting of barley, wheat, oats, canola, flax, hemp, bagasse, rice, sunflowers, hay and grass. Most preferably the straw particles are selected from the group of plants consisting of barley, wheat, oats and canola.

The step of treating the lignocellulosic particles is preferably comprised of combining the lignocellulosic particles with an aqueous acidic solution, which is preferably a dilute solution of a weak acid such as a carboxylic acid (preferably acetic acid), a very dilute solution of a strong acid such as hydrochloric acid or sulphuric acid, or a combination thereof. Preferably the aqueous acidic solution has a hydrogen ion concentration of between about 0.0025 moles per liter and about 0.006 moles per liter. Preferably, the treating step is comprised of combining the lignocellulosic particles with a sufficient amount of aqueous acidic solution so that the straw particles are combined with between about 0.001 and 0.003 moles of hydrogen ions per kilogram of oven dry straw particles. The straw particles may be combined with the aqueous acidic solution by spraying the straw particles with the aqueous acidic solution.

Preferably, contact between the straw particles and the aqueous acidic solution is then maintained for a period of time. Preferably contact is maintained for between about 5 minutes and about 60 minutes, and more preferably for between about 10 minutes and about 30 minutes.

The lignocellulosic particles may have any moisture content for the treating step, but preferably they have a moisture content of less than about 20 percent by oven dry weight of lignocellulosic particles when they are combined with the aqueous acidic solution. Most preferably, the lignocellulosic particles have a moisture content of between about 5 percent and about 20 percent by oven dry weight of straw particles when they are combined with the aqueous acidic solution.

The lignocellulosic particles and the aqueous acidic solution may be at any temperature for the treating step, but preferably at least a portion of the treating step occurs at a temperature of at least about thirty degrees Celsius.

The invention may also be comprised of the step of combining the straw particles with the binder. The binder may be any binder which is suitable for gluing lignocellulosic particles, including both formaldehyde based binders and isocyanate based binders. Preferably, however, at least a portion of the binder is a formaldehyde based resin such as an urea formaldehyde resin ("UF"), a melamine formaldehyde resin ("MF" or "MUF") or a phenol formaldehyde resin ("PF"). Mixtures of different binders may also be used. For example, a formaldehyde based resin such as UF may be used for some portions of the article while an isocyanate based binder such as MDI may be used for other portions of the article. Preferably the lignocellulosic particles have a moisture content of less than about 15 percent by oven dry weight of straw particles by the time that the step of combining the straw particles with the binder is finished.

The lignocellulosic particles may be of any size, but preferably they have a maximum dimension of less than about 200 millimeters during the treating step. More preferably they have a maximum dimension of less than about 50 millimeters during the treating step. Most preferably, the lignocellulosic particles have a maximum dimension of less than about 25 millimeters during the treating step.

The invention may be used to produce any type of article from the lignocellulosic particles and the binder. Production of the article comprises the step of forming the article from combined lignocellulosic particles and binder followed by the step of curing the binder to produce the article. Preferably the binder is a thermosetting binder which is cured by heating of the article. Preferably the article is a panel which is formed by creating a mat of combined lignocellulosic particles and binder. The binder is then cured to produce the panel.

DETAILED DESCRIPTION

The present invention relates to a process for the production of articles from particles of a lignocellulosic material and a binder. The lignocellulosic material may be of any type, including wood and straw. The binder may be of any type which is suitable for bonding lignocellulosic material, including formaldehyde based resins and isocyanate based binders. Combinations of different lignocellulosic materials and binders may also be used in the production of a single article using the invention.

In the preferred embodiment, the invention relates to the production of panels from straw particles. In this patent application, "straw particles" include fibers, flakes and other particles which are obtained from the stalks, stems or leaves of plants, but do not include wood fibers, wood flakes or wood particles.

In the preferred embodiment, the straw particles are obtained from the group of plants consisting of barley, wheat, oats and canola. Other types of straw particles may, however, be used in the invention, including but not limited to those obtained from the group of plants consisting of flax, hemp, bagasse, rice, sunflowers, hay and grass.

In the preferred embodiment, the invention is directed at reducing the cost and other problems associated with the production of strawboard, which is a composite material constructed from straw particles and binder. In particular, in the preferred embodiment the invention is directed at enabling the use of formaldehyde based resins as an effective binder in the production of strawboard.

The invention may be used or adapted for use in conjunction with many different processes for the production of articles from lignocellulosic materials and binder, since the invention relates primarily to an additional process step or additional process steps which can be incorporated into many different processes. The invention therefore is directed at a process improvement rather than a new overall process.

In the past, formaldehyde based resins have enjoyed great success as binders for wood particles but have not proven themselves to be effective for use in binding straw particles. This shortcoming is conventionally attributed to the relative weakness of formaldehyde based resins as binders and to a wax coating which covers straw particles and which has been believed to interfere with adhesion of the formaldehyde based resin to straw particles. Isocyanate based binders are generally thought to be capable of overcoming the shortcoming associated with formaldehyde based resins because of the relative strength of isocyanates as binders. The present invention, however, challenges these beliefs based upon some inherent characteristics of straw particles and formaldehyde based resins.

Formaldehyde based resins are known to form bonds most effectively when they are cured in an acidic environment, preferably at a pH of between about 3.0 to about 3.5. Conversely, isocyanate based binders such as MDI cure most effectively in an alkaline environment having a pH greater than about 7.0.

Wood particles tend to have a natural pH of approximately 3.0 and a natural buffering capacity of between about 50 meq. to about 80 meq. of aqueous sulfuric acid. Straw particles on the other hand tend to have a natural pH of between about 6.0 and about 7.5 and a natural buffering capacity between about 300 meq. to about 450 meq. of aqueous sulfuric acid.

It might therefore be predicted that in terms of optimization of curing conditions, formaldehyde based resins would be naturally suited for use in binding wood particles and less naturally suited for use in binding straw particles. It might also be predicted that isocyanate based binders would be naturally suited for use in binding straw particles and perhaps less naturally suited for use in binding wood particles.

In its most simple form, the invention comprises the step of treating lignocellulosic material before it is combined with binder by exposing the lignocellulosic material to an acidic environment. As a result, although the invention may be used in conjunction with processes utilizing any lignocellulosic material and any binder, the invention is best suited for use in processes where formaldehyde based resins are intended to be used in the production of straw-based articles such as strawboard, because the treating step tends to render straw particles more compatible with formaldehyde based resins.

Although the precise manner in which the invention works is not known, it is believed that the treating step may have one or more effects upon the chemistry of the straw particles. First, the treating step may reduce the pH and/or the buffering capacity of the surfaces of the straw particles. Second, the treating step may cause esterification of hydroxyl groups on the cellulose chains in the straw particles. Third, the treating step may catalyze the reaction of the formaldehyde based resin with the phenolic nuclei of the lignin in the straw particles. Any of these possible effects upon the chemistry of the straw particles may have the overall effect of creating a more favourable environment for the curing of a formaldehyde based resin. It is also possible that the presence of the acid may alter the surface chemistry of formaldehyde based resins by reducing their surface tension, thus allowing the formaldehyde based resins better access to the surface of the straw particles under the waxy layer to bond with the straw particles.

As a result, in the preferred embodiment, at least a portion of the binder that is used to bind the straw particles is a formaldehyde based resin such as for example an urea formaldehyde resin ("UF"), a melamine fortified urea formaldehyde resin ("MF" or "MUF") or a phenol formaldehyde resin ("PF"). Most preferably, at least a portion of the binder is an urea formaldehyde resin ("UF").

In the preferred embodiment, the treating step is therefore comprised of exposing the straw particles to an acidic environment. The treating step is preferably comprised of combining the straw particles with a sufficient amount of aqueous acidic solution so that the straw particles are combined with between about 0.001 and about 0.003 moles of hydrogen ions per kilogram of oven dry straw particles.

Most preferably, the treating step is comprised of combining the straw particles with the aqueous acidic solution and then maintaining contact between the straw particles and the aqueous acidic solution for a period of time. Although there is no upper limit to this period of time, it is desirable that it be minimized in order to maintain the efficiency and cost effectiveness of the overall process. The preferred period of time for maintaining contact between the straw particles and the aqueous acidic solution has been found to vary inversely with the temperature at which the treating step is performed. Preferably the period of time is between about 5 minutes and about 60 minutes, and most preferably is between about 10 minutes and about 30 minutes.

The straw particles may be combined with the aqueous acidic solution by any method. In the preferred embodiment the straw particles are sprayed with the aqueous acidic solution. The contact between the straw particles and the aqueous acidic solution may be maintained in any manner. In the preferred embodiment, the straw particles and aqueous acidic solution are maintained in contact in a container or vessel until the treating step is completed.

The aqueous acidic solution is preferably comprised of a dilute solution of a weak acid or a very dilute solution of a strong acid (or combinations thereof) such that the hydrogen ion concentration of the aqueous acidic solution is between about 0.0025 moles per liter and about 0.006 moles per liter. In this patent application, a "weak acid" includes acids having an acid equilibrium constant with an order of magnitude of between about $10^{-4}$ to about $10^{-11}$, and a "strong acid" includes acids having an acid equilibrium constant with an order of magnitude greater than about $10^{-4}$.

In the preferred embodiment, the aqueous acidic solution is a dilute solution of a carboxylic acid, specifically acetic acid or a very dilute solution of hydrochloric acid or sulfuric acid. More specifically, in the preferred embodiment the aqueous acidic solution is a 5 percent (by volume) solution of acetic acid.

In the preferred embodiment, the straw particles preferably have a maximum dimension of less than about 200 millimeters when they undergo the treating step. More preferably the maximum dimension of the straw particles during the treating step is less than about 50 millimeters and most preferably is less than about 25 millimeters. The size of the straw particles during the treating step will, however, depend upon the type of straw-based product that is being produced. For the straw-based equivalent of oriented strand board ("OSB"), the maximum dimension of the straw particles may approach or even exceed 50 millimeters, while for the straw-based equivalent of medium density fibreboard ("MDF") the maximum dimension of the straw particles may only be several millimeters or less.

The treating step has been found to be most effective when the straw particles have a moderately high moisture content of between about 5 percent and about 20 percent by oven dry weight of straw particles when they are combined with the aqueous acidic solution, presumably because a moderate moisture content facilitates more even dispersal of the aqueous acidic solution throughout the straw particles. In addition, it has been found that a moisture content in this range results in minimization of the time required to perform the treating step.

As a result, in the preferred embodiment, the straw particles have a moisture content of less than about 20 percent by oven dry weight of straw particles and most preferably between about 5 percent and about 20 percent by oven dry weight of straw particles at the beginning of the treating step. The desired moisture content may be achieved either by utilizing initially wet straw particles in the process or by adding water to the straw particles before the treating step.

The treating step may be performed at any temperature which is above the freezing point of water, including temperatures within the steam phase of the water contained in the straw particles or in the aqueous acidic solution. As previously indicated, however, it has been found that the preferred length of time for completing the treating step varies inversely with the temperature at which the treating step is performed. As a result, for best results a balance should be sought between the temperature at which the treating step is performed and the length of time for performing the treating step in order to optimize the performance of the treating step.

In the preferred embodiment at least a portion of the treating step is performed at a temperature of at least 30 degrees Celsius, but the maximum temperature is also controlled in order to manage the amount of energy which is required to perform the treating step. The desired temperature may be achieved either by utilizing heat which has previously been input in the process or by heating the straw particles and/or the aqueous acidic solution prior to the treating step. The temperature may also be adjusted upwards or downwards during the treating step. If at least a portion of the treating step is performed at a temperature of at least 30 degrees Celsius, it has been found that the most preferred period of time for maintaining contact between the straw particles and the aqueous acidic solution during the treating step is between about 10 minutes and about 30 minutes.

In the preferred embodiment, the treating step and thus the invention may be performed as part of an overall process for producing strawboard articles or the treating step may be separately performed on straw particles which are later used in the production of strawboard articles. The description that follows provides one example of how the invention may in the preferred embodiment be incorporated into an overall process for the production of strawboard.

First, straw particles are selected, preferably from the group of plants consisting of barley, wheat, oats and canola. These straw particles are processed to reduce their size by grinding them in a tub grinder to produce straw particles having a maximum dimension of less than about 300 millimeters, and preferably a maximum dimension of between about 50 millimeters and 100 millimeters.

Next, the straw particles are size classified by either mechanical or pneumatic methods to eliminate dirt, other deleterious material and very fine straw particles. The very fine straw particles which are screened out may constitute as much as 15 percent by oven dry weight of the total amount of straw particles which are size classified.

After the screening step, the moisture content of the remaining straw particles is adjusted to up to about 30 percent by oven dry weight of straw particles.

The straw particles are then passed through a hammermill or an attrition mill to reduce the size of the straw particles further so that they have a maximum dimension of between about 5 millimeters and about 50 millimeters, depending upon the type of strawboard article which is being produced.

The straw particles are preferably subjected to the treating step after they have undergone the milling step. If desired, the moisture content of the straw particles may be adjusted prior to performance of the treating step to between about 5 percent and 20 percent by oven dry weight of straw particles in order to optimize the performance of the treating step.

As outlined previously, the treating step preferably involves subjecting the straw particles to an acidic aqueous solution until the straw particles have been combined with between about 0.001 and about 0.003 moles of hydrogen ions per kilogram of oven dry straw particles. The straw particles may be sprayed and blended with the aqueous acidic solution, following which contact between the straw particles and the aqueous acidic solution may be maintained in order to provide the hydrogen ions with an opportunity to react with the straw particles.

Following the treating step, the straw particles may either be dried to be made ready for combining with a binder or binders or they may be fed into a further size reducing apparatus such as a refiner in order to achieve a desired straw particle geometry. For example, if the strawboard equivalent of particleboard is being produced, the straw particles may be subjected to refining in order to create straw particles having a maximum dimension that is very small. Following the refining step, the straw particles are then dried to be made ready for combining with a binder or binders.

Whether they are dried after the treating step or after the refining step, the straw particles are preferably dried either before or while they are combined with binder to a moisture content of between about 1 percent to about 15 percent by oven dry weight of straw particles.

Once the straw particles are dried to less than about 15 percent by oven dry weight of straw particles, or simultaneously with the drying step, they are combined with one or more binders so that the moisture content of the straw particles is between about 1 percent and about 15 percent before completion of the step of combining the straw particles with the binder or binders. Where the article to be produced is a strawboard panel, a mat comprised of strawboard particles and binder is formed. Both formaldehyde based resins and isocyanate based binders may be used in a single article in order to take advantage of the relative strengths of the two different types of binders.

For example, some of the problems associated with isocyanate based binders (including their propensity to stick to press platens) may be overcome by using a combination of straw particles and isocyanate based binder for the inner core portions of the strawboard panel and by using a combination of straw particles and formaldehyde based resin for the outer face portions of the strawboard panel.

After the strawboard panel or other article has been formed, the binder or binders may be cured to produce the article by applying a combination of heat and pressure to the formed mat or other article using a press or other method.

In the above example, the treating step is performed after the milling step but before the refining step. It should be noted, however, that this example is not to be construed as limiting the application of the invention and in particular the treating step. The treating step may be performed at any point in the strawboard production process. In particular, the treating step may be performed before milling, during milling or after milling of the straw particles and may also be performed before, during or after refining of the straw particles. The optimal time for performing the treating step will be governed by process design limitations and by energy efficiency considerations.

As discussed, use of the treating step in a process for the production of strawboard facilitates the effective use of formaldehyde based resins as a binder in the product. The reason for this is that performance of the treating step results in a better bond being formed between the straw particles and formaldehyde based resins.

Conventionally, in strawboard products where the treating step has not been performed, the internal bond strength between the straw particles and formaldehyde based resin binders is typically less than about 0.45 $N/mm^2$. It has been found that where the treating step is performed before the straw particles are combined with binder the internal bond strength between straw particles and formaldehyde based resin binder has the potential to be increased to between about 0.58 $N/mm^2$ and about 0.75 $N/mm^2$, depending upon the type and concentration of aqueous acidic solution that is used in the treating step and upon the type and quantity of binder that is used.

It has been found that the use of dilute solutions of weak acids or very dilute solutions of strong acids in the treating step potentially result in the best internal bond strength between straw particles and formaldehyde based resin binders. For example, a very diluted solution of hydrochloric acid seems to provide better results than does a more concentrated solution of hydrochloric acid. As previously indicated, regardless of the type of aqueous acidic solution that is used in the invention, preferably the concentration of hydrogen ions in the aqueous acidic solution is between about 0.0025 moles per liter and about 0.006 moles per liter.

A particularly preferred class of acids for use in the treating step is carboxylic acids. In particular, the use of acetic acid in the treating step has been shown to result in a potential internal bond strength between straw particles and formaldehyde based resin binders exceeding 0.68 $N/mm^2$. One possible explanation for this is the presence of carboxyl groups in carboxylic acids, which carboxyl groups may react with the hydroxyl groups in the cellulose chains of the straw particles to alter the chemistry of the straw particles. The best results thus far have been obtained using a dilute solution (approximately 5 percent by volume) of acetic acid, which has a concentration of hydrogen ions of about 0.0039 moles per liter.

The potential to use formaldehyde based resins as effective binders in the production of straw-based articles such as strawboard offers several advantages. First, the cost of production may be reduced by substituting all or a portion of the conventional and expensive isocyanate based binders with more economical formaldehyde based resins. Second, by using formaldehyde based resins at least on the face portions of articles such as strawboard panels, the tendency of isocyanate bound straw particles to stick to press platens can be avoided. Third, since formaldehyde based resins impart some inherent "stickiness" or "tack" to formed but uncured articles such as strawboard mats, the integrity of the uncured article and its handling characteristics may be improved. Finally, the use of formaldehyde based resins as binders in at least the face portions of straw based articles better facilitates the use of lamination materials as an overlay, since lamination materials bond more easily to formaldehyde based resins than they do to isocyanate based binders.

The embodiments of the invention in which an exclusive property or privilege is claimed are defined as follows:

1. A process for producing articles comprising particles of a lignocellulosic material and a binder, wherein the particles of lignocellulosic material are comprised of straw particles having a maximum dimension of less than about 200 millimeters and wherein the binder is comprised of a formaldehyde based resin, consisting essentially of the following steps in the sequence set forth:

(a) providing the straw particles;

(b) treating the straw particles in a treatment step consisting essentially of combining the straw particles with an aqueous acidic solution and then maintaining contact between the straw particles and the aqueous acidic solution for a period of time;

(c) combining the straw particles with the binder;

(d) forming the article; and (e) curing the binder to produce the article.

2. The process as claimed in claim 1 wherein the maximum dimension of the straw particles is less than about 50 millimeters.

3. The process as claimed in claim 1 wherein the straw particles are obtained from the group of plants consisting of barley, wheat, oats and canola.

4. The process as claimed in claim 1 wherein the straw particles are obtained from the group of plants consisting of flax, hemp, bagasse, rice, sunflowers, hay and grass.

5. The process as claimed in claim 1 wherein the maximum dimension of the straw particles is less than about 100 millimeters.

6. The process as claimed in claim 1 wherein the straw particles are combined with a sufficient amount of aqueous acidic solution so that the straw particles are combined with between about 0.001 and about 0.003 moles of hydrogen ions per kilogram of oven dry straw particles.

7. The process as claimed in claim 1 wherein the aqueous acidic solution has a hydrogen ion concentration of between about 0.0025 moles per liter and about 0.006 moles per liter.

8. The process as claimed in claim 7 wherein the straw particles are combined with a sufficient amount of aqueous acidic solution so that the straw particles are combined with between about 0.001 and about 0.003 moles of hydrogen ions per kilogram of oven dry straw particles.

9. The process as claimed in claim to 8 wherein period of time for maintaining contact between the straw particles and the aqueous acidic solution is between about 10 minutes and about 30 minutes.

10. The process as claimed in claim to 8 wherein the aqueous acidic solution is comprised of a solution of acetic acid.

11. The process as claimed in claim 10 wherein the process further consists essentially of the step of drying the straw particles to a moisture content of less than about 15 percent by oven dry weight of straw particles after the treating step and before or during the step of combining them with the binder.

12. The process as claimed in claim 7 wherein the period of time for maintaining contact between the straw particles and the aqueous acidic solution is between about 5 minutes and about 60 minutes.

13. The process as claimed in claim 7 wherein at least a portion of the treating step occurs at a temperature of at least about thirty degrees Celsius.

14. The process as claimed in claim 1 wherein the binder comprises an urea formaldehyde resin.

15. The process as claimed in claim 1 wherein the aqueous acidic solution is comprised of a solution of carboxylic acid.

16. The process as claimed in claim 1 wherein the aqueous acidic solution is comprised of a solution of acetic acid.

17. The process as claimed in claim 16 wherein the binder comprises an urea formaldehyde resin.

18. The process as claimed in claim 16 wherein the aqueous acidic solution has a hydrogen ion concentration of between about 0.0025 moles per liter and about 0.006 moles per liter.

19. The process as claimed in claim 18 wherein the binder comprises an urea formaldehyde resin.

* * * * *

UNITED STATES PATENT AND TRADEMARK OFFICE
Certificate

Patent No. 6,666,951 B1 Patented: December 23, 2003

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Darren J. Kostiw, Westlock, Alberta, Canada; and Wayne Wasylciw, Edmonton, Alberta, Canada.

Signed and Sealed this Twelfth Day of April 2005.

STEVEN P. GRIFFIN
*Supervisory Patent Examiner*
Art Unit 1731